US007530639B2

(12) United States Patent
Groelsma et al.

(10) Patent No.: US 7,530,639 B2
(45) Date of Patent: May 12, 2009

(54) CHAIR WITH ADJUSTABLE FOOT SUPPORT

(75) Inventors: John C. Groelsma, Jenison, MI (US); John F. Aldrich, Grandville, MI (US); Christopher C. Hill, Zeeland, MI (US); Craig A. Ulman, Rockford, MI (US)

(73) Assignee: Herman Miller, Inc., Zeeland, MI (US)

( * ) Notice: Subject to any disclaimer, the term of this patent is extended or adjusted under 35 U.S.C. 154(b) by 154 days.

(21) Appl. No.: 11/455,013

(22) Filed: Jun. 16, 2006

(65) Prior Publication Data

US 2007/0158993 A1 Jul. 12, 2007

Related U.S. Application Data

(60) Provisional application No. 60/757,213, filed on Jan. 6, 2006.

(51) Int. Cl.
*A47C 7/50* (2006.01)

(52) U.S. Cl. ..... 297/423.38; 297/344.18; 297/463.1

(58) Field of Classification Search ..... 297/300.2, 297/344.18, 344.19, 423.1, 423.38, 463.1
See application file for complete search history.

(56) References Cited

U.S. PATENT DOCUMENTS

| | | | | |
|---|---|---|---|---|
| 611,327 | A | 9/1898 | Kelly | |
| 665,471 | A | 1/1901 | Sauder | |
| 1,590,240 | A | 6/1926 | Gorton | |
| 1,723,363 | A | 8/1929 | McArdle | |
| 2,308,358 | A * | 1/1943 | Cramer | 297/423.38 |
| 2,329,697 | A | 9/1943 | Davies | |
| 2,351,194 | A | 6/1944 | Davies | |
| 2,542,480 | A | 2/1951 | Cramer et al. | |
| 2,659,413 | A | 11/1953 | Cramer | |
| 2,755,842 | A | 7/1956 | Carmelli | |
| 3,161,435 | A | 12/1964 | Halverson | |
| 3,167,292 | A | 1/1965 | Meyerowitz | |
| 3,376,068 | A | 4/1968 | Walkinshaw | |
| 3,385,550 | A | 5/1968 | Doerner | |
| 3,458,234 | A | 7/1969 | Bates | |
| 3,642,320 | A | 2/1972 | Ward | |
| 3,720,442 | A | 3/1973 | Bergmann et al. | |
| 3,751,759 | A | 8/1973 | Duncan | |
| 3,837,611 | A | 9/1974 | Rhoades | |
| 4,238,097 | A | 12/1980 | Clausen et al. | |
| 4,348,051 | A | 9/1982 | Boucher | |
| 4,408,801 | A | 10/1983 | Edel et al. | |
| 4,623,195 | A | 11/1986 | Avella | |
| 4,818,135 | A | 4/1989 | Desjardins | |
| 5,031,869 | A * | 7/1991 | Strater et al. | 248/406.1 |
| 5,090,513 | A * | 2/1992 | Bussinger | 180/271 |

(Continued)

*Primary Examiner*—David Dunn
*Assistant Examiner*—Patrick Lynch
(74) *Attorney, Agent, or Firm*—Brinks Hofer Gilson & Lione

(57) ABSTRACT

A chair includes a base and a seating structure rotatably coupled to the base and vertically moveable between at least a first position and a second position. A foot support is disposed a vertical distance from the seating structure. The foot support is rotatably coupled to the seating structure and non-rotatably coupled to the base. A control mechanism is operably coupled to the foot support for adjusting the vertical distance between the foot support and the seat. The control mechanism includes a control handle operably coupled to the seating structure. The control handle rotates with the seating structure when the seating structure is rotated and moves vertically with the seating structure when the seating structure is vertically moved between the first position and the second position.

25 Claims, 16 Drawing Sheets

U.S. PATENT DOCUMENTS 5,265,838 A 11/1993 Kjellman
D368,380 S * 4/1996 Olson et al. ..... D6/366
5,690,185 A * 11/1997 Sengel ..... 180/65.1
5,740,997 A 4/1998 Van Wieran
5,908,221 A 6/1999 Neil
5,988,754 A 11/1999 Lamart et al.
6,003,944 A * 12/1999 Glockl ..... 297/337
6,012,775 A 1/2000 Czarnecki
6,050,585 A * 4/2000 Rai ..... 280/288.4
6,315,262 B1 11/2001 Hur
6,419,323 B1 7/2002 Chu et al.
6,540,296 B1 4/2003 Shats et al.
6,695,407 B1 2/2004 Lin
D497,266 S * 10/2004 Tai ..... D6/366
2003/0151291 A1 * 8/2003 Lin et al. ..... 297/423.38
2003/0209931 A1 * 11/2003 Glaser ..... 297/344.12

* cited by examiner

CHAIR WITH ADJUSTABLE FOOT SUPPORT

RELATED APPLICATIONS

This application claims the benefit of U.S. Provisional Patent Application No. 60/757,213, filed Jan. 6, 2006, the entire disclosure of which is hereby incorporated herein by reference.

BACKGROUND

The present invention relates to chairs with foot supports, and more particularly relates to a chair having a vertically adjustable foot support.

Chairs are often provided with foot supports to support the feet of seated users. This is especially true for chairs, such as stools, that have rotatable seats positioned too high for seated users to comfortably rest their feet on a floor. Users generally prefer that the foot support be at a selected distance from the seat, so that their feet are comfortably supported and so that they can push off of the foot support to rotate the seat. Unfortunately, with conventional designs, when the seat is vertically adjusted, the distance from the seat to the foot support also changes. Thus, the foot support must also be made adjustable. However, many customers do not want to have to separately adjust the foot support after the seat is adjusted.

In most stools, adjusting the foot support is a source of frustration. The user has to leave the seat, loosen a knob or lock, move the foot support, and lock the foot ring. If the user's foot support height estimate is off, the operation must be repeated. Another common user complaint is the requirement to touch the foot support to adjust its height. The user must grab and shimmy the support to the desired height. Most foot supports are difficult to adjust, and the user must apply extra energy to move the support to the height desired. Touching the foot support also creates a cleanliness problem, which is especially important in labs or clean-room environments. If users touch the foot support, they will need to wash their hands before they return to their work.

Because of these difficulties, most people do not attempt to adjust their foot support to the proper height, which leads to chronic uncomfortable foot support positioning. This problem is compounded in applications where the stool is used in multiple shifts, and users do not bother to adjust the height of the foot support on a daily basis.

BRIEF SUMMARY

In various aspects, a chair is provided with a foot support that a user may adjust while sitting on the seat. The foot support moves vertically with the seat when the seat is vertically adjusted, but does not rotate with the seat when the seat is rotated.

In one aspect, a chair includes a base and a seating structure rotatably coupled to the base and vertically moveable between at least a first position and a second position. A foot support is disposed a vertical distance from the seating structure. The foot support is rotatably coupled to the seating structure and non-rotatably coupled to the base. A control mechanism is operably coupled to the foot support for adjusting the vertical distance between the foot support and the seat. The control mechanism includes a control handle operably coupled to the seating structure. The control handle rotates with the seating structure when the seating structure is rotated and moves vertically with the seating structure when the seating structure is vertically moved between the first position and the second position.

In another aspect, a chair includes a base and a seat rotatably coupled to the base and vertically moveable between at least a first position and a second position. The seat includes a top surface with a nadir and a side edge. The side edge defines a vertical plane and the nadir defines a horizontal plane. A foot support is disposed a vertical distance from the seating structure and rotatably coupled to the seating structure and non-rotatably coupled to the base. A control mechanism is operably coupled to the foot support for adjusting the vertical position of the foot support. The control mechanism includes a control handle with a distal end. The distal end of the control handle is disposed at a horizontal location within 3 inches of the vertical plane defined by the side edge of the seat and a vertical location within 18 inches of the horizontal plane defined by the nadir of the top surface of the seat.

In another aspect, a method of adjusting a foot support includes providing a chair including a base, a seat, the foot support, and a control mechanism. The base includes a support column. A seat is supported by the support column and vertically moveable between at least a first position and a second position. The foot support is disposed a vertical distance from the seat and rotatably coupled to the seat and non-rotatably coupled to the base. The control mechanism is operably coupled to the foot support. The method includes sitting on the seat and adjusting the control mechanism while sitting on the seat to change the vertical distance between the seat and the foot support without vertically moving the seat.

DETAILED DESCRIPTION

Figure 1:
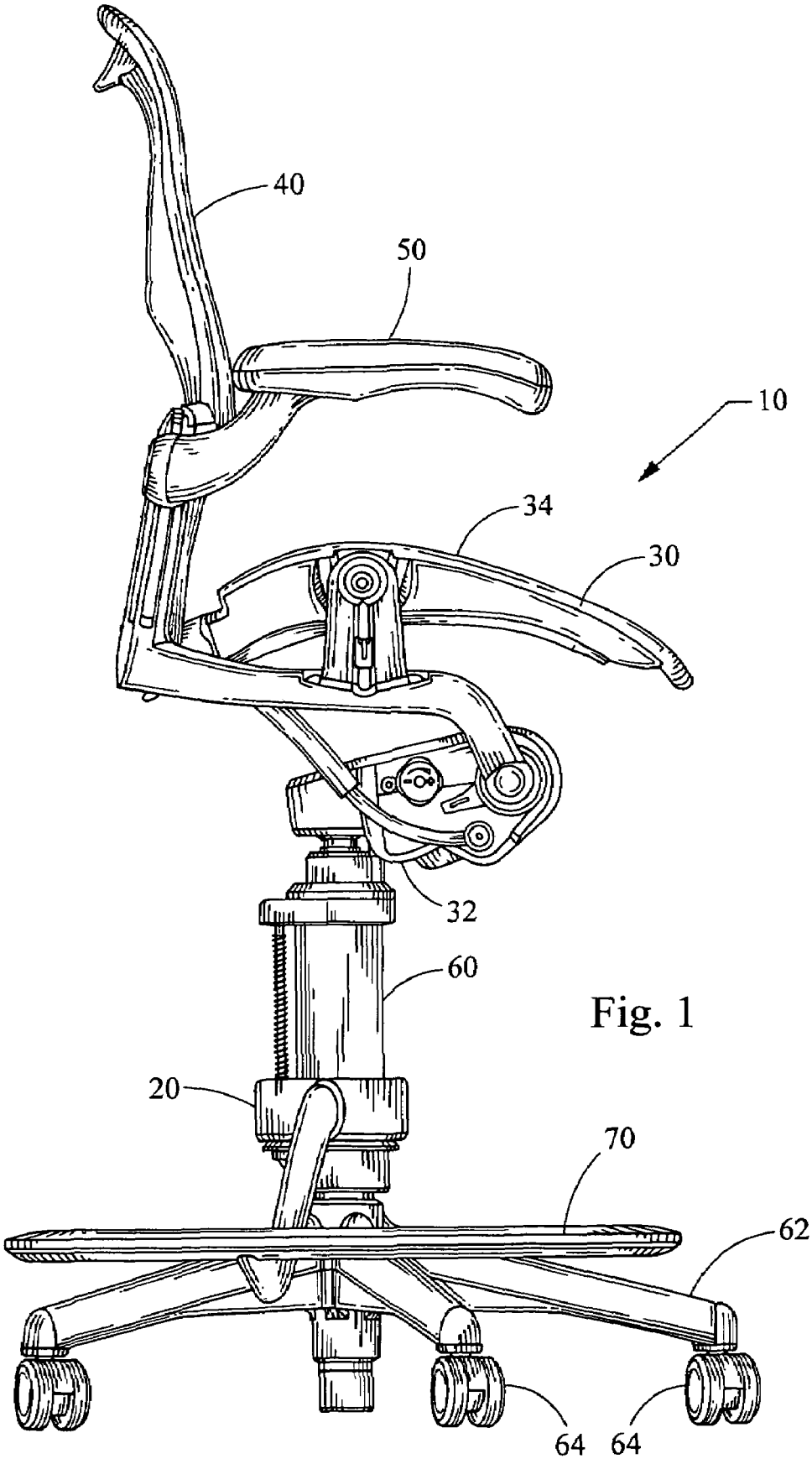
FIG. 1 is a side view of a chair including a first embodiment of a foot support assembly.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

Figure 1A:
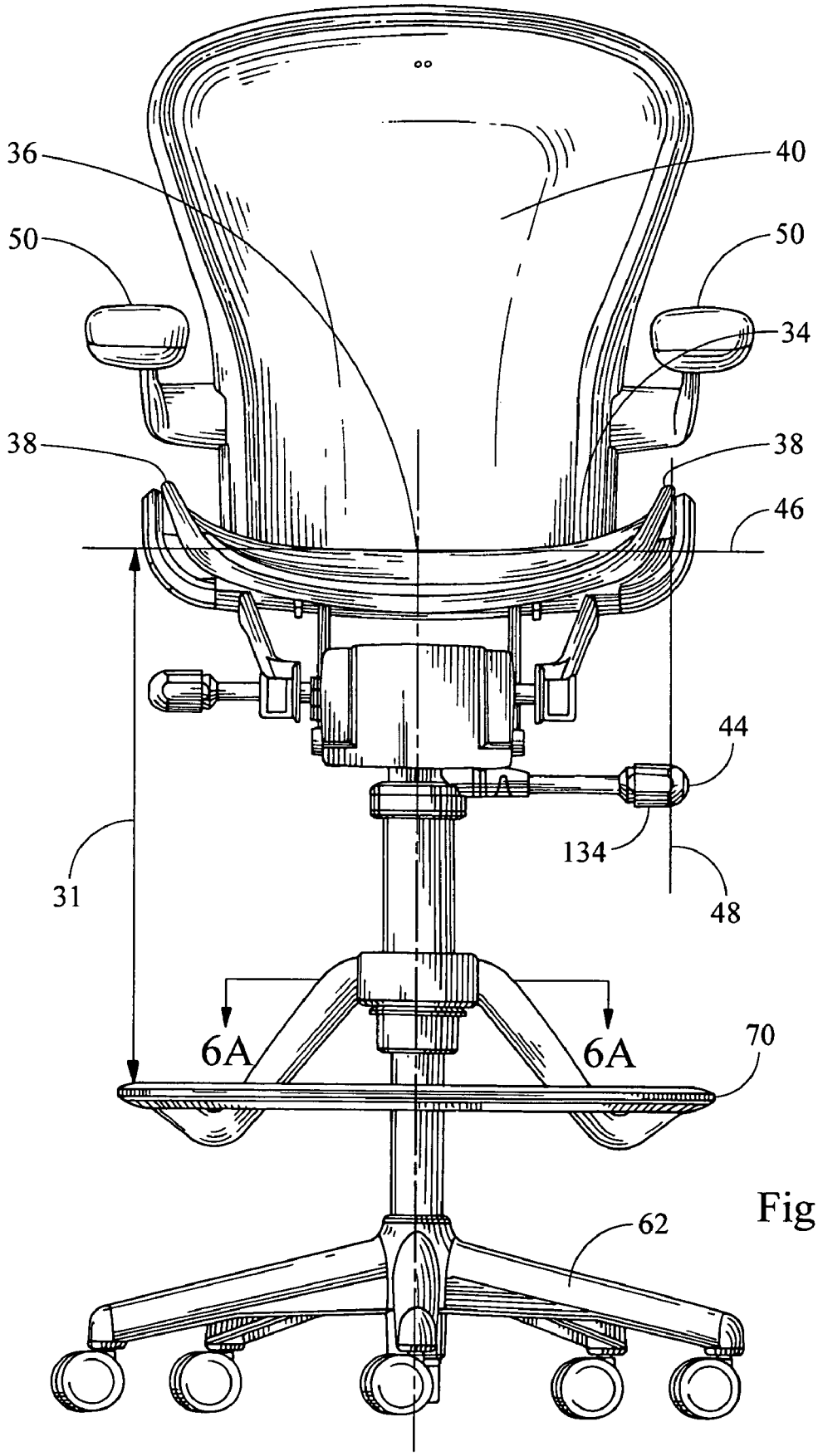
FIG. 1A is a front view of the chair of FIG. 1

A chair 10 including a first embodiment of a foot support assembly 20 is shown in FIGS. 1 and 1A. The chair includes a seating structure (such as seat 30), a backrest 40, armrests 50, base 60, and a foot support 70. The base 60 is supported by a pedestal 62 with a plurality of casters 64. The seat 30 is operably supported by a support column 218 (not shown) in the base 60. The seat 30 is rotatably coupled to the base 60 and vertically moveable between at least a first position and a second position. The term "coupled" generally means connected to or engaged with whether directly or indirectly, for example with an intervening member, and does not require the engagement to be fixed or permanent, although it may be fixed or permanent, and includes both mechanical and electrical connection.

Exemplary versions of the chair without a foot support assembly may be found in U.S. Pat. No. 6,386,634 entitled "Office Chair," the contents of which are hereby incorporated by reference herein. In one preferred embodiment, the chair is an Aeron® chair (available from Herman Miller, Inc., having a place of business in Holland, Mich., USA). It will be apparent that the foot support assemblies disclosed herein can be used with a wide variety of different chair types.

The chair includes a foot support assembly 20 with a foot support 70 disposed a vertical distance 31 from the seat 30. The foot support 70 is rotatably coupled to, and therefore rotates with respect to, the seat 30, and non-rotatably coupled to the base 60. The foot support 70 moves vertically with the seat 30 when the seat 30 is vertically adjusted, but does not rotate with the seat 30 when the seat 30 is rotated. Thus, when a user adjusts the height of the seat 30, the foot support 70 maintains the same distance relative to the seat 30. Additionally, due to the location of the control mechanism, a user can adjust the height of the foot support 70 while sitting on the seat 30.

Figure 2:
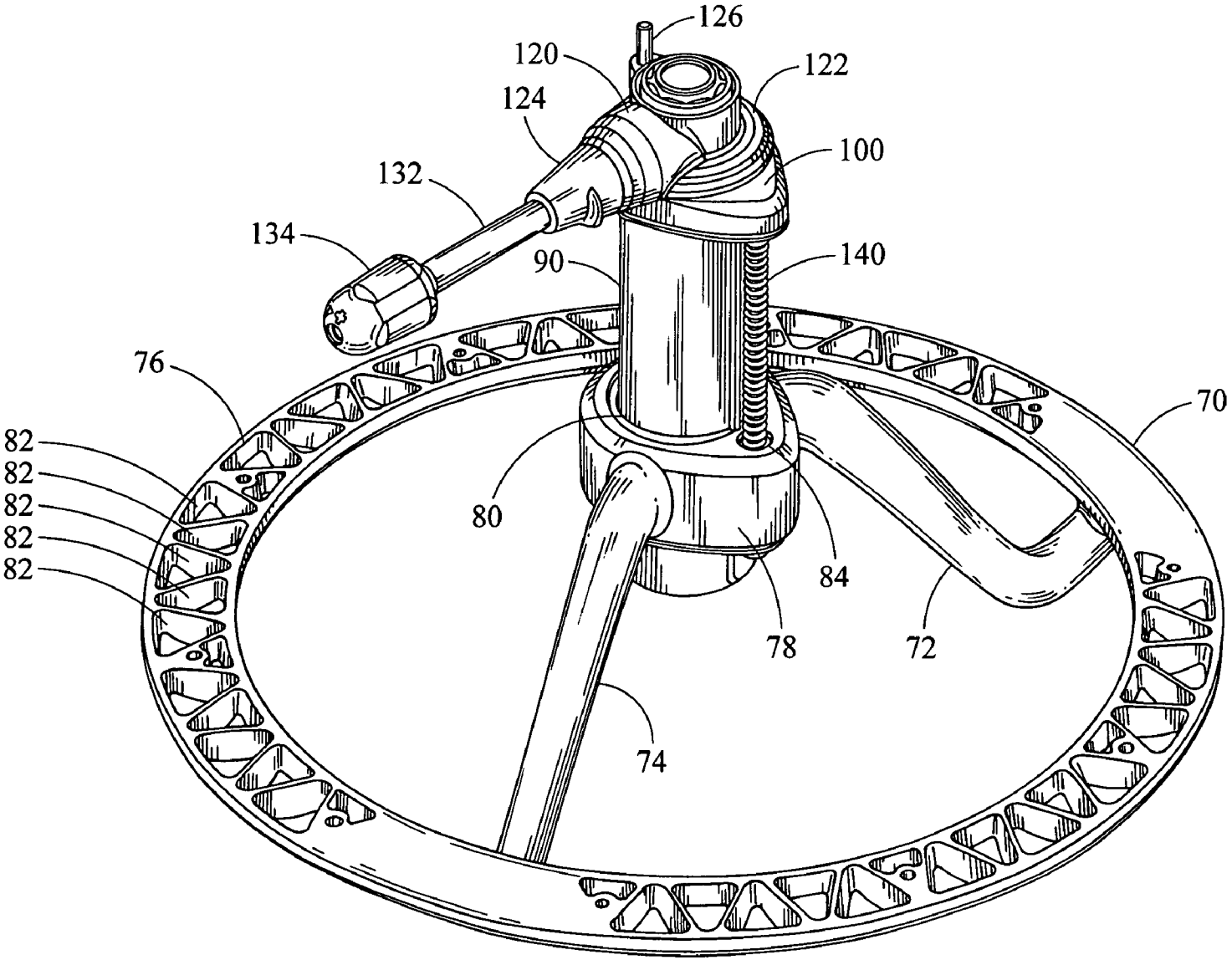
FIG. 2 is a perspective view of a first embodiment of a foot support assembly.

A first embodiment of a foot support assembly 20 is shown in FIG. 2. The foot support 70 includes two arms 72, 74 connecting a foot resting surface 76 to a center portion 78. The center portion 78 includes a center aperture 80. The center aperture 80 is disposed around the outer support tube 90 of the base 60. The foot support 70 is adapted to slide up and down the support tube 90. The outer support tube 90 supports the vertical force exerted on the foot support 70. The foot support 70 is vertically supported by the support column 218 (not shown) and rotatably connected to the seat 30.

Figure 3:
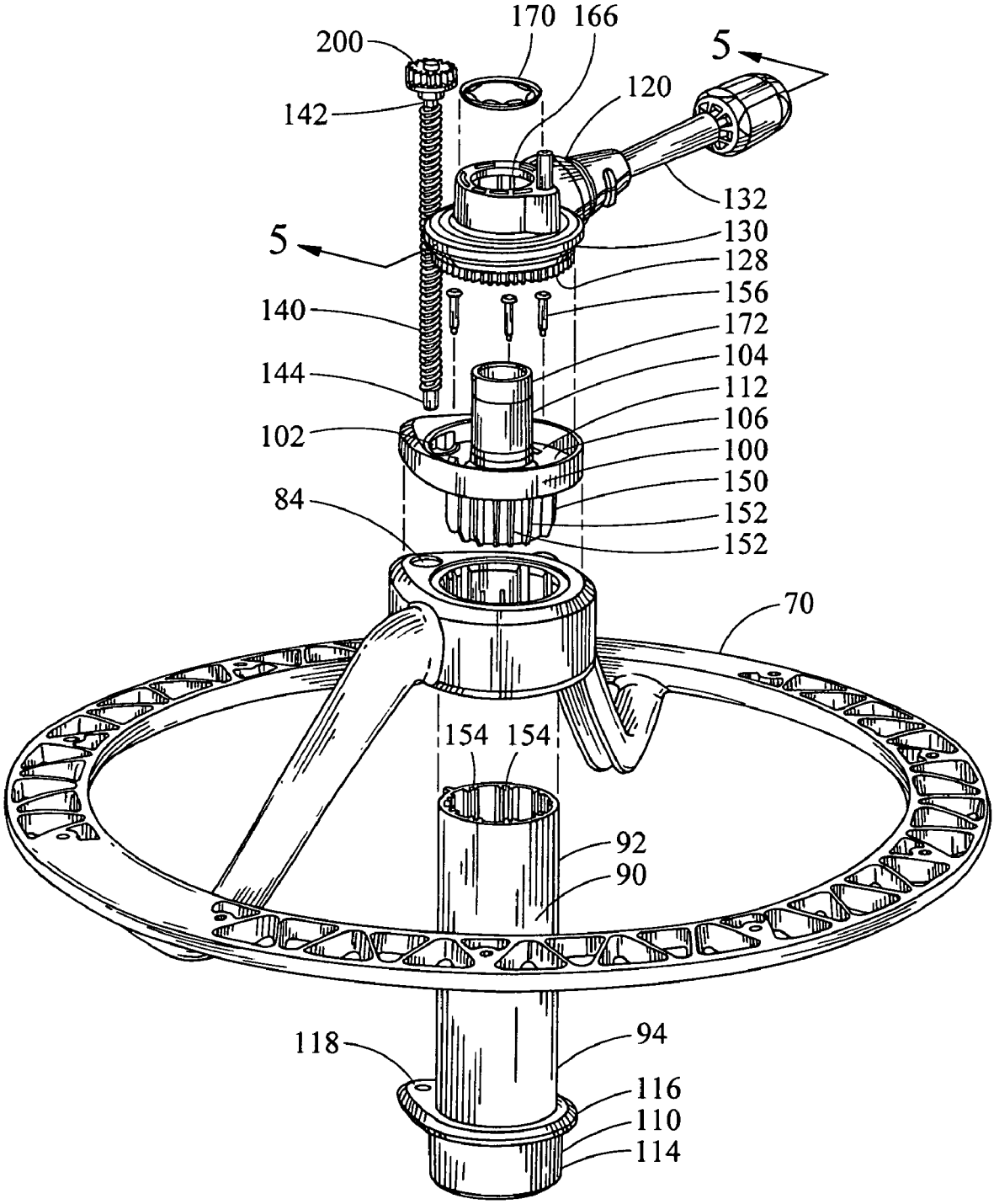
FIG. 3 is an exploded view of a first embodiment of a foot support assembly.

As shown in FIGS. 2 and 3, disposed at the top 92 of the support tube 90 is a top cap 100. Disposed above the top cap 100 is a gear housing 120. A lead screw 140 runs from the top cap 100, through a portion of the foot support 70, and to a bottom cap 110. The lead screw 140 operably couples the foot support 70 to the control mechanism 130 within the gear housing 120. The top end 142 of the lead screw 140 is secured within the top cap 100, and the bottom end 144 of the lead screw 140 is secured to the bottom cap 110. The top cap 100 includes a downward opening aperture 102 for positioning of the top end 142 of the lead screw 140. The lead screw 140 is able to rotate freely with respect to the top and bottom caps 100, 110. The foot support 70 includes a threaded aperture 84 that mates with the threads in the lead screw 140. Thus, rotation of the lead screw 140 causes the foot support 70 to move up or down, depending on the direction of the rotation. The top and bottom caps 100, 110 also serve as limits to the travel of the foot support 70. When the seat 30 is vertically adjusted, the foot support 70, the outer support tube 90, and the top and bottom caps 100, 110 move vertically with the seat.

The gear housing 120 is coupled to the seat 30, such that the housing 120 rotates with the seat 30 when the seat 30 is rotated. Disposed within the gear housing 120 is a control mechanism 130 for adjusting the vertical position of the foot support 70. The control mechanism 130, which will be described in more detail below, includes a control shaft 132 and one or more gears. The control shaft 132 extends from the gear housing 120 in a generally horizontal direction. The gear housing 120 includes a center portion 122 and an extending portion 124 surrounding the control shaft 132. The control mechanism 130 includes a control handle 134 operably coupled to the foot support 70 and disposed adjacent the seat 30 bottom. By rotating the control shaft 132, a user can adjust the position of the foot support 70. At the top portion of the gear housing 120 is a pin 126. The pin 126 is operably coupled to the seat 30 so that the gear housing 120 rotates with the seat 30.

In one embodiment, the control handle 134 is disposed adjacent the seat bottom such that a user can adjust the vertical height of the foot support 70 while sitting on the seat 30. In particular, as shown in FIG. 1A, the seat top surface 34 includes side edges 38 and a lowest point or nadir 36. The side edge 38 defines a vertical plane 48 and the nadir 36 defines a horizontal plane 46. The distal end 44 of the control handle 134 is disposed at a horizontal location within 3 inches of the vertical plane 48 and at a vertical location within 18 inches of the horizontal plane 46. In various embodiments, the distal end 44 is disposed at a horizontal location within 2 inches, 1 inch, or 0.5 inches of the vertical plane 48, and at a vertical location within 16 inches, 14 inches, or 12 inches of the horizontal plane 46. Although the control handle 134 is shown as a particular cylindrical shape, it will be apparent that the control handle could be fashioned as other shapes such as a dial, a knob, wheel, lever, or the like.

FIG. 3 shows an exploded view of the foot support assembly 20. A bottom cap 110 is disposed around a bottom portion 94 of the outer support tube 90 and is attached thereto. The foot support 70 moves against the outer surface of the outer support tube 90. A top insert 150 is secured within the top portion 92 of the outer support tube 90. The top cap 100 is disposed above the top insert 150 and is connected thereto. The gear housing 120 rests on top of the top cap 100.

Figure 6A:
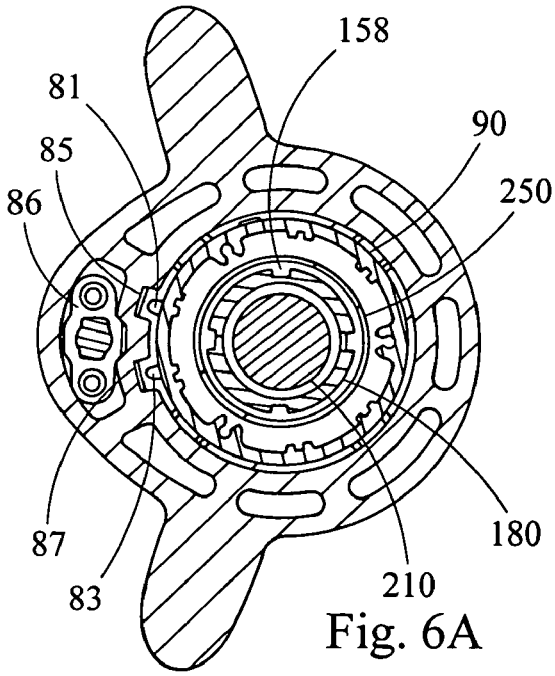
FIG. 6A is a bottom cross-sectional view of a portion of the foot support of a first embodiment of a foot support assembly.
Figure 7:
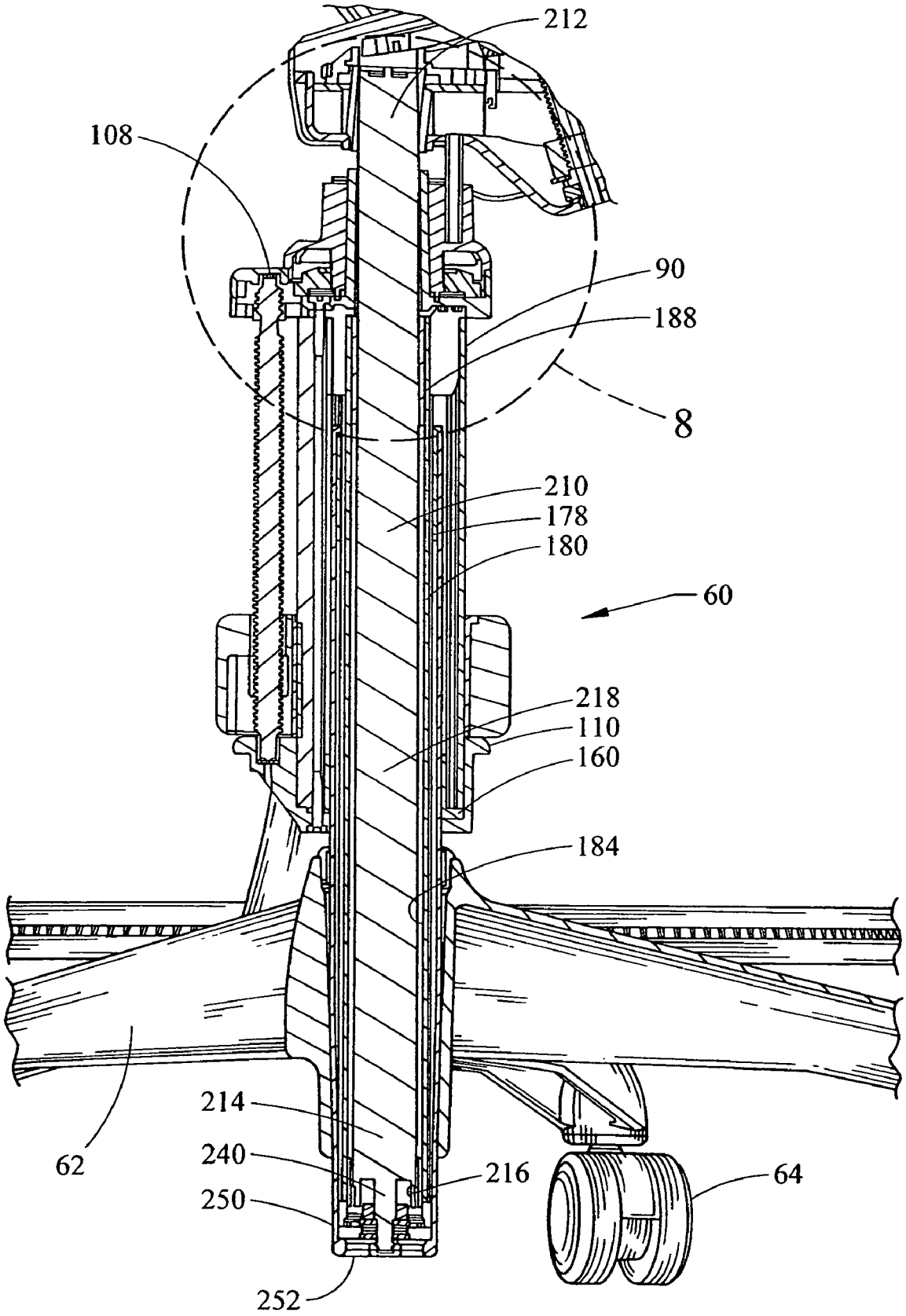
FIG. 7 is a sectional view of chair including a first embodiment of a foot support assembly in a first position.
Figure 8:
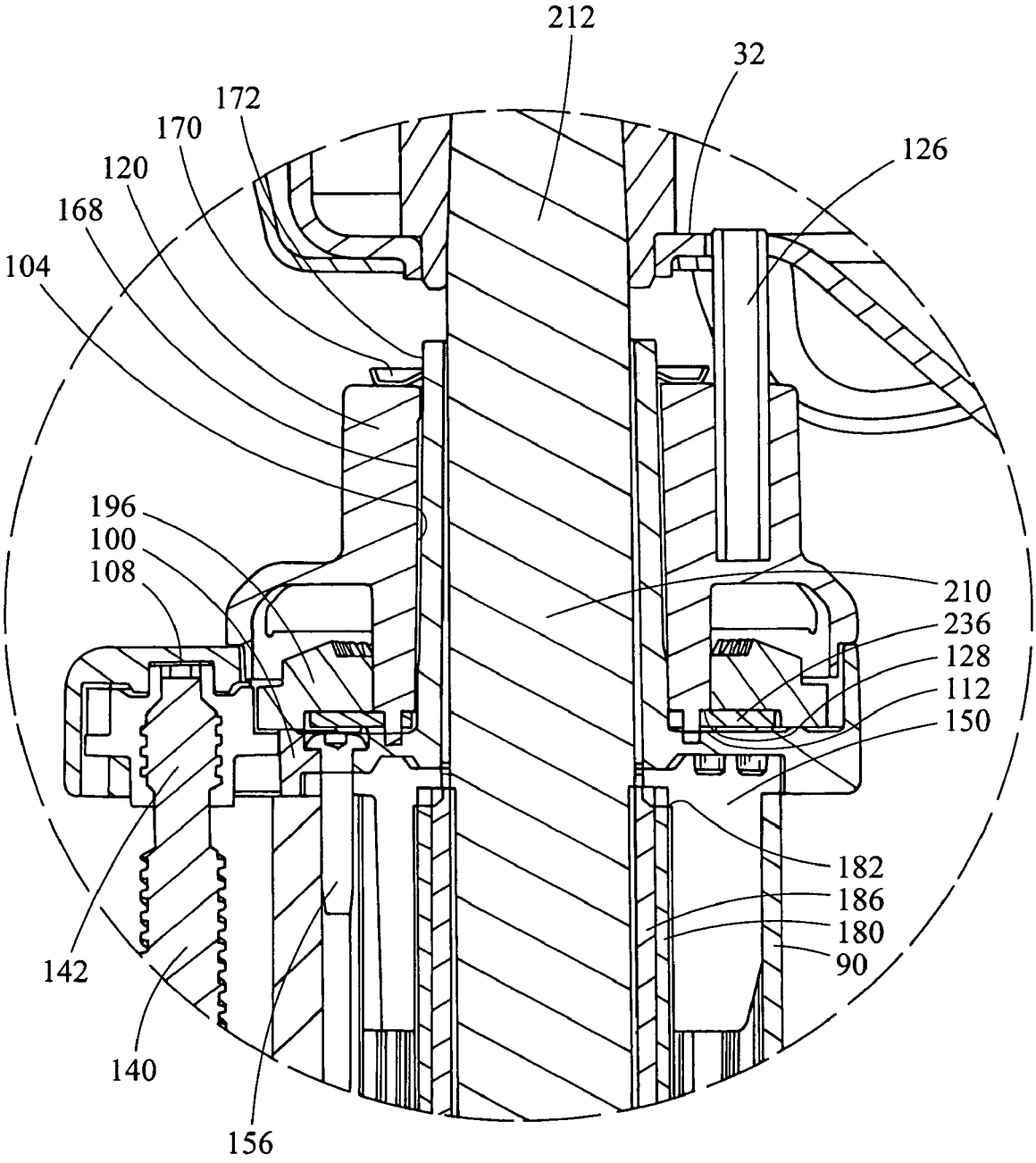
FIG. 8 is an enlarged view of a portion of FIG. 7.

As best seen in FIGS. 7 and 8, the top insert 150 rests on the top of the intermediate tube 180 and is disposed between the outer surface of the intermediate tube 180 and the inner surface of the outer support tube 90. In one embodiment, the top insert 150 includes a series of outer ridges 152 that correspond to channels 154 in the interior surface of the outer support tube 90 to hold the top insert 150 in place and prevent rotation with respect to the outer support tube 90. The top insert 150 may also include inner ridges (not shown) that correspond to channels 158 in the outer surface of the intermediate tube 180. (see FIG. 6A). In one embodiment, fasteners 156 connect the top cap 100 to the top insert 150. Alternatively, the top cap 100 and top insert 150 may be integrally formed as one piece. The top cap 100 includes a vertically extending annular portion 104, a horizontally extending portion 106, and an opening 102 for the lead screw 140. The vertically extending annular portion 104 of the top cap 100 fits around the support column 218, which may part of an inner telescoping tube 210. The gear housing 120 rests on the top surface 112 of the horizontally extending portion 106 of the top cap 100. A retaining ring 170 attaches to the top of the gear housing 120 and bears against the outer surface 172 of the vertically extending annular portion 104 of the top cap 100 to retain the gear housing 120 in the vertical direction.

As seen in FIG. 7, a bottom insert 160, similar to the top insert 150, is disposed between the outer surface of the intermediate tube 180 and the inner surface of the outer support tube 90. In one embodiment, the bottom insert 160 includes a series of ridges (not shown) that correspond to channels 154 in the interior surface of the outer support tube 90 to hold the bottom insert 160 in place. The bottom insert 160 is connected to the bottom cap 110, preferably by fasteners (not shown). Alternatively, the bottom cap 110 and bottom insert 160 may be integrally formed as one piece. As seen in FIG. 3, the bottom cap 110 includes a vertically extending annular portion 114, a horizontally extending portion 116, and an attachment point 118 for the lead screw 140. The attachment point for the lead screw 140 is preferably disposed in the horizontally extending portion 116 of the bottom cap 110.

Figure 4:
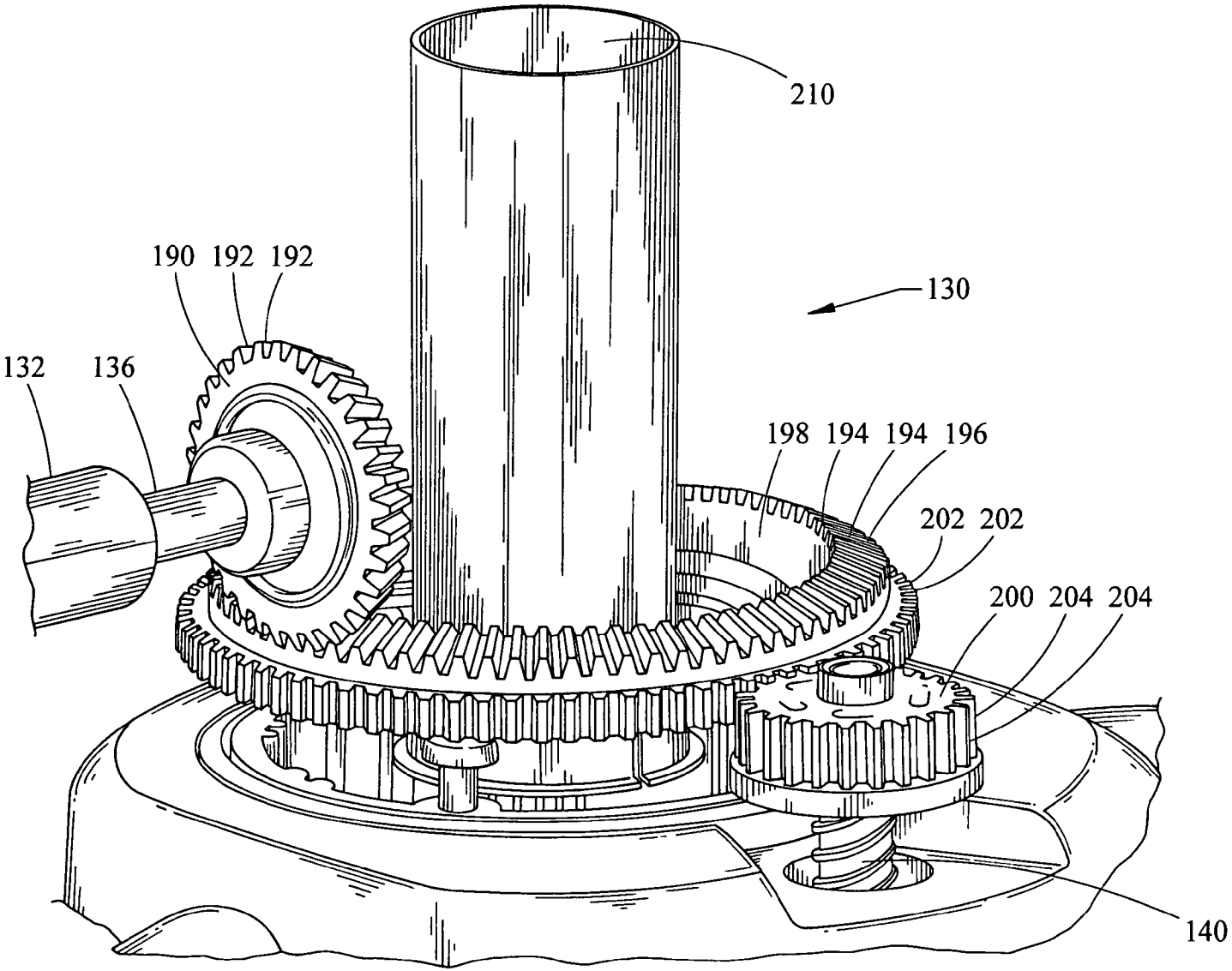
FIG. 4 is a perspective view of the components of a first embodiment of a foot support assembly.

An enlarged view of the control mechanism 130 with the top cap 100 removed is shown in FIG. 4. The gear design permits the vertical location of the foot support 70 to be adjustable in infinitesimal increments. The second end 136 of the control shaft 132 is attached to a gear wheel 190. The teeth 192 of gear wheel mesh with the teeth 194 of a second gear wheel 196. The second gear wheel 196 is oriented in a horizontal plane and includes a center aperture 198 disposed around the inner telescoping tube 210. The teeth 202 of the second gear wheel 196 mesh with the teeth 204 of a third gear wheel 200. The third gear wheel 200 is disposed in a horizontal plane and is attached to the end of the lead screw 140. Thus, when a user turns the control handle 134, the rotation of the control shaft 132 causes gear wheel 190 to rotate, which engages and rotates gear wheel 196, which engages and rotates gear wheel 200, which causes the lead screw 140 to rotate. In one embodiment, the foot support 70 can move its entire vertical travel along the outer support tube 90 with less than 40 revolutions of the control shaft 132. It will be apparent that other types of gear arrangements are possible to transfer rotational movement from the control shaft 132 to the lead screw 140.

Figure 5:
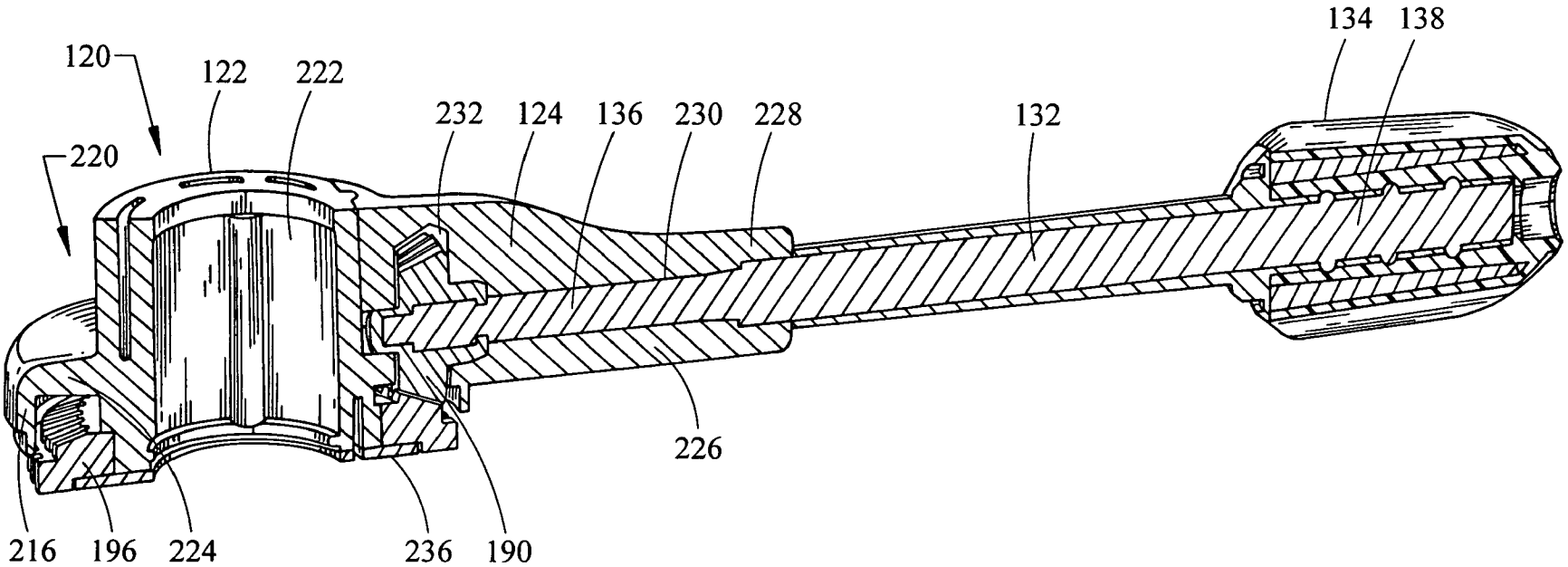
FIG. 5 is a sectional view along line 5-5 of FIG. 3 of the control assembly of a first embodiment of a foot support assembly.

FIG. 5 shows a cutaway view of the gear housing 120, including the components of the control mechanism 130. In one embodiment, the gear housing 120 includes a main portion 122 and an extending arm portion 124. The main portion 122 includes a vertically extending annular portion 220 with a center opening 222 and a horizontally extending flange 224. Horizontally extending flange 224 includes a lip 216 extending around at least a portion of gear wheel 196. The extending arm portion 124 includes a base 226 and an arm cover 228. The extending arm portion 124 includes a channel 230 for holding the control shaft 132 and an opening 232 for gear wheel 190. Removal of the arm cover portion 228 allows the control shaft 132 to be inserted during assembly. The first end 138 of the control shaft 132 includes a handle 134 and the second end 136 is attached to a first gear wheel 190. The second gear wheel 196 operably couples the first gear wheel 190 to the lead screw 140, such that rotation of the control shaft 132 causes vertical movement of the foot support 70. A ring-shaped bottom retainer 236 is attached to the bottom of the gear housing 120 and holds the gear wheel 196 in place in the gear housing 120.

Figure 6:
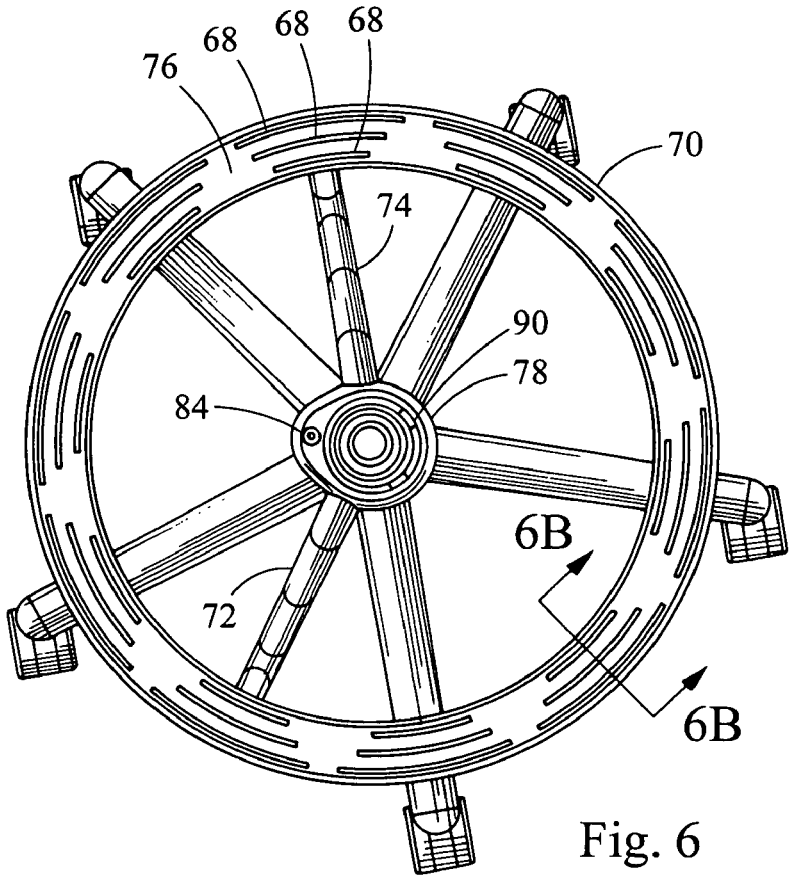
FIG. 6 is a top sectional view of the foot support of a first embodiment of a foot support assembly.

As shown in FIG. 6, in the first embodiment, the foot resting surface 76 of the foot support 70 extends 360° around the support tube 90. In other embodiments, the foot resting surface 76 extends around only a portion of the support tube 90. The foot resting surface 76 will generally extend at least around the front portion of the support tube 90 (i.e. the area under a user's feet). The foot resting surface 76 may include a pattern, such as a series of ridges 68. The pattern may be decorative or it may be designed to ensure better grip of a user's feet to the foot resting surface 76. As best seen in FIG. 6B, in one embodiment, the foot support includes a die cast aluminum ring 52 with a plastic cover 58. The aluminum ring 52 may include apertures 82 to reduce the amount of material used. (see FIG. 2). The aluminum ring 52 includes notches 52, 54 along its outer and inner top surfaces, respectively, to allow the securing of an outer lip 57 and inner lip 55 of the cover. The plastic cover may be fashioned from a hard material such as ABS, with the ridges 68 comprising a grippy material such as TPE.

Figure 6B:
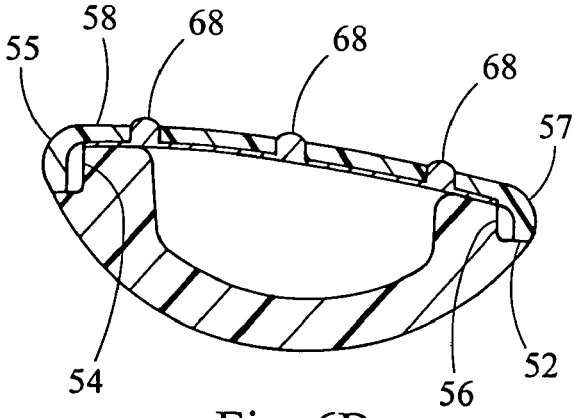
FIG. 6B is a side sectional view of the foot support along line 6B-6B of FIG. 6.

FIG. 6A is a bottom cross-sectional view of a portion of the foot support 70 and the base 60. The outer support tube 90 may includes vertically oriented ribs 81, 83 disposed along the length of the outer support tube 90. The inner surface of the center portion 78 of the foot support 70 may include channel portions 85, 87 disposed around ribs 81, 83. Ribs 81, 83 help restrain the foot ring 70 to prevent it from rotating with respect to the outer support tube 90.

Figure 6C:
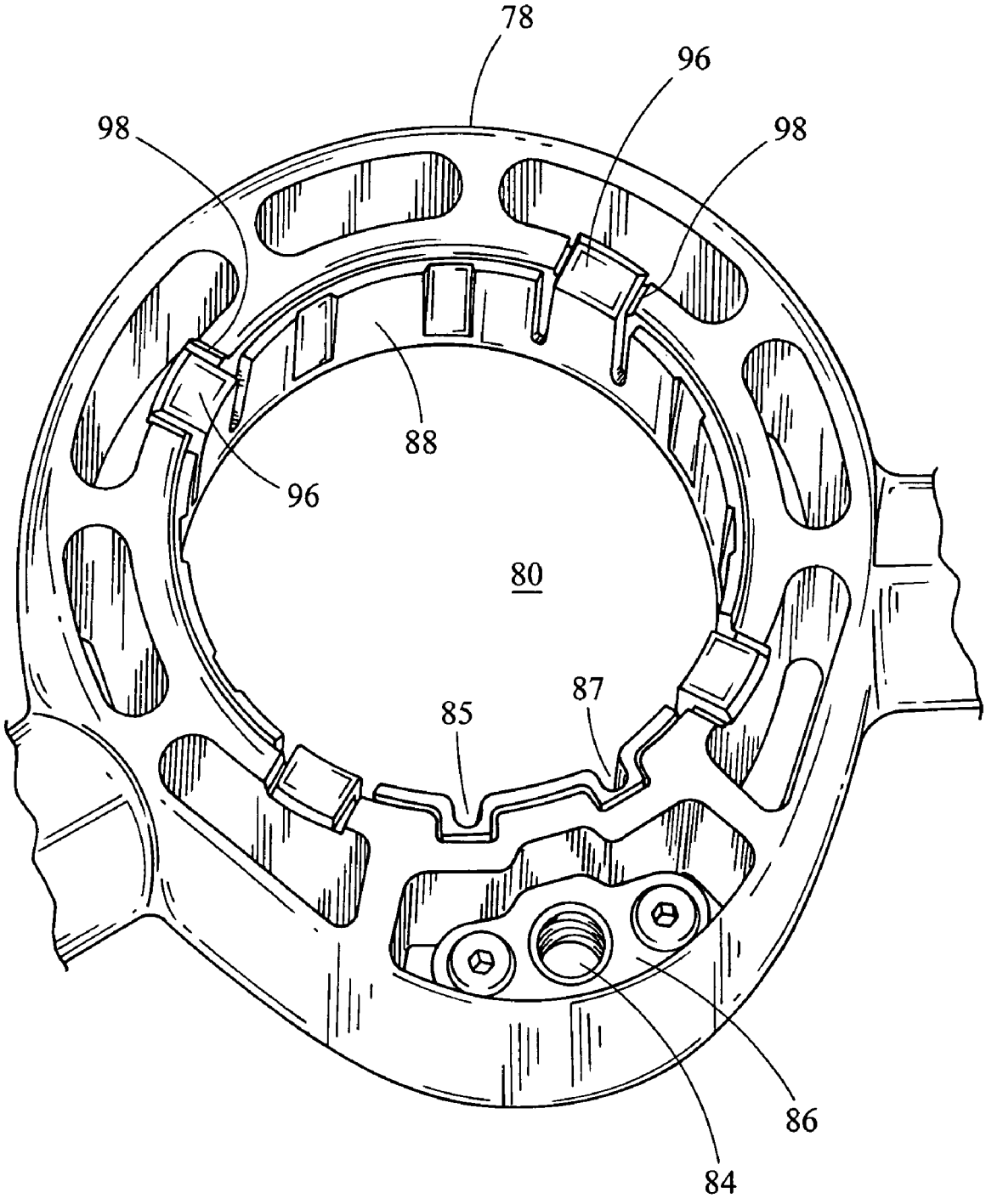
FIG. 6C is a bottom view of a portion of the foot support of a first embodiment of a foot support assembly.

FIG. 6C shows a bottom view of the center portion 78 of the foot support 70. A threaded aperture 84 disposed in the center portion 78 mates with the lead screw 140 to allow vertical movement of the foot support 70. The threaded aperture 84 may be provided in an insert 86 that is fastened to the center portion 78. A bushing 88 may be used in the vertical inner surface of the center aperture 80 to enhance the vertical movement against the outer support tube 90. The bushing 88 may include clips 96 that secure the bushing 88 to depressions 98 in the surface of the center portion. The bushing may include channel portions 85, 87 for use with ribs 81, 83 on the outer surface of the outer support tube 90.

As shown in FIGS. 7 and 8, the base 60 includes an outer guide tube 250 mounted to the pedestal 62. An intermediate tube 180 is slidably positioned within the outer guide tube 250. The foot support 70 is supported by the inner telescoping tube 210. In particular, the foot support 70 is connected to the outer support tube 90, which is connected to the intermediate tube 180 through the top and bottom end caps 100, 110. The inner telescoping tube 210 supports the intermediate tube 180, which is slidably positioned within the outer guide tube 250. The intermediate tube 180 preferably has a shoulder 182 at the top of the tube 180. The lower section 184 of the intermediate tube 180 slidably bears against the outer guide tube 250, and when locked in a desired position, the overlapping area of the outer guide tube 250 and intermediate tube 180 offsets any moments acting on the tubes to support a user sitting on the chair. An outer guide tube bushing 178 may be disposed between the intermediate tube 180 and the outer guide tube 250. To limit the upward travel of the intermediate tube 180, a retaining collar (not shown) may be mounted to the top of the outer guide tube 250. The intermediate tube 180 is rotationally fixed relative to the outer guide tube 250. The intermediate tube 180 may include channels 158 (see FIG. 6A) that allow the top insert 150 to non-rotatably attached thereto.

The inner telescoping tube 210 is vertically fixed, but rotates relative to, the intermediate tube 180. The inner telescoping tube 210 has an upper portion 212 which is coupled to the tilt mechanism 32 or the seat 30. The upper portion 212 of the support column 218 is rotationally coupled to the foot support 70. The foot support 70 and the upper portion 212 of the support column 218 move vertically with the seat 30 when the seat 30 is moved between the first position and the second position. The inner telescoping tube 210 is vertically fixed within the intermediate tube 180 but rotatably bears against the upper section 188 of the intermediate tube 180. An intermediate tube bushing 186 may be disposed between the intermediate tube 180 and the inner telescoping tube 210. A retaining collar 216 is mounted to a bottom edge 214 of the inner telescoping tube 210 and connects the inner telescoping tube to the lower section 184 of the intermediate tube 180. The retaining collar 216 carries the intermediate tube 180 therewith when the inner telescoping tube 210 moves vertically.

Figure 7A:
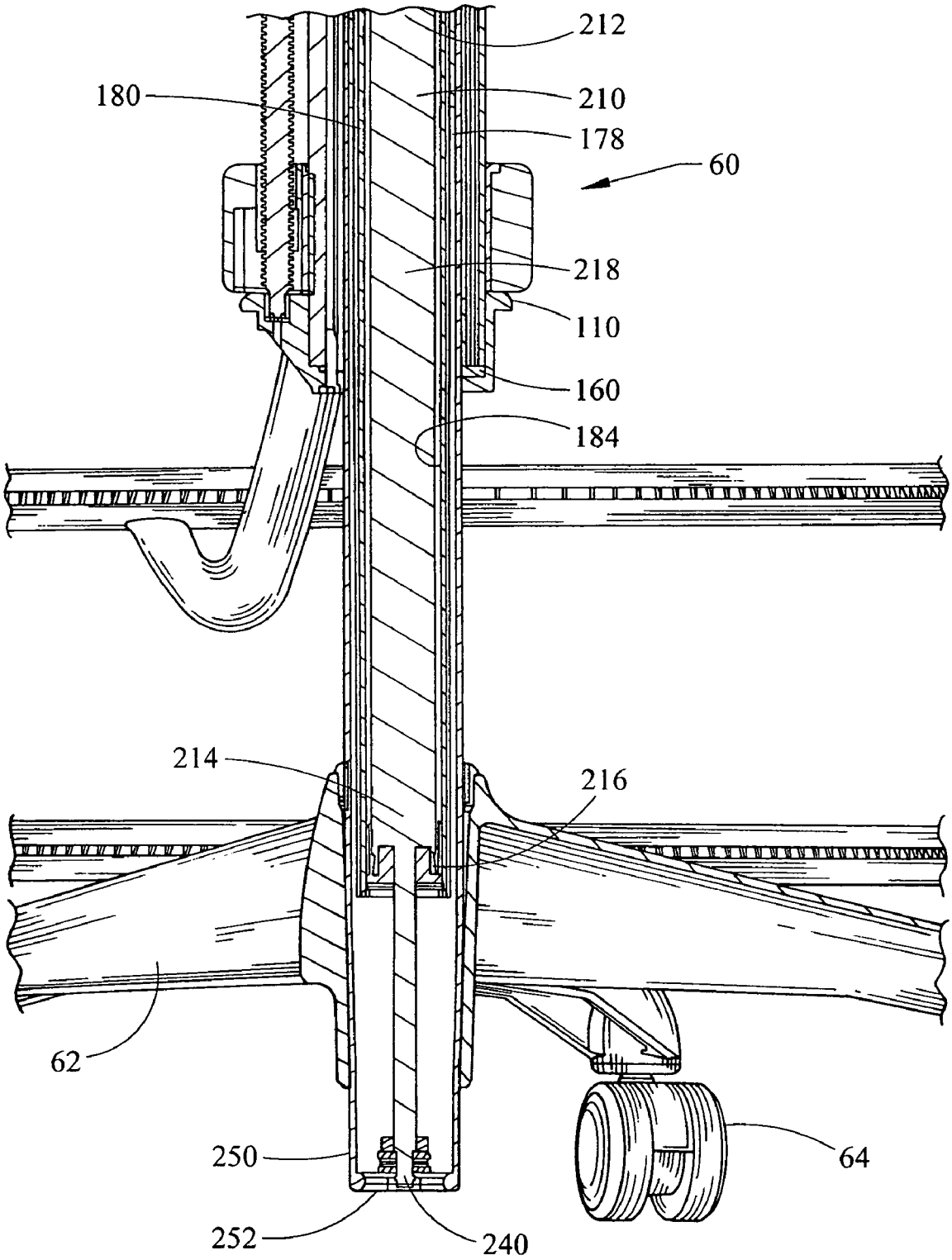
FIG. 7A is a sectional view of chair including a first embodiment of a foot support assembly in a second position.

To adjust the vertical position of the seat 30, a support column 218 is mounted within the inner telescoping tube 210. The downward force of the seat 30 is supported entirely by the support column 218. In one embodiment, the support column 218 is a vertically extendable spring such as a conventional gas spring including a pneumatic cylinder. However, other types of support arrangements and types of springs are possible. A piston rod 240 extends outwardly from the cylinder in an axial direction and has an end connected to the bottom wall 252 of the outer guide tube 250. The piston rod 240 is extensible between a collapsed position (shown in FIG. 7) and a raised position (shown in FIG. 7A). In the collapsed position, the inner telescoping tube 210 and the intermediate tube 180 are substantially within the outer guide tube 250. In the raised position, the upper section 212 of the intermediate tube 180 extends upwardly from the outer guide tube 250. The inner telescoping tube 210 is non-rotatably coupled to the seat 30 such that the inner telescoping tube 210 rotates with respect to the intermediate tube 180 as the seat 30 rotates.

An exploded view of the gear housing 120 portion of FIG. 7 is shown in FIG. 8. The top insert 150 is disposed between the inner surface of outer support tube 90 and the outer surface of the intermediate tube 180, and rests on the shoulder 182 of the intermediate tube 180. The top cap 100 is connected to the top insert 150 by fasteners 156. The inner telescoping tube 210 is disposed through the center portion of the top cap 100 and the gear housing 120. The bottom surface 128 of the gear housing 120 and bottom retainer 236 rest on the top surface 112 of the horizontally extending portion 106 of the top cap 100. The top portion 142 of the lead screw 140 is disposed in aperture 108 in the top cap 100. The retaining ring 170 attaches to the top of the gear housing 120 and retains the gear housing 120 in the vertical direction with respect to the top cap 100. The pin 126 extends upwards from the gear housing 120 to engage the tilt control mechanism 32 of the seat 30. The pin 126 does not vertically support the seat 30. The pin 126 may also extend to a portion of the seat 30 itself, or to another element fixed to the seat 30.

The components of the foot support assembly and the chair may be made of any suitable material, and are generally plastic, aluminum, or steel. In particular, the foot support 70 and the support tube 90 may be aluminum; the various bushings, top cap 100, bottom cap 110, top insert 150, bottom insert 160, and gear wheels may be plastic, such as 43% glass filled nylon; the guide pin 126, lead screw 140, outer guide tube 250, intermediate tube 180, and inner telescoping tube 210 may be steel.

In operation, the user sits on the seat 30 and rotates the control handle 134 to adjust the foot support 70 to a comfortable position. As the user turns the control handle 134, the rotation of the control shaft 132 causes gear wheel 90 to rotate, which engages and rotates gear wheel 196, which engages and rotates gear wheel 200, which causes the lead screw 140 to rotate, thus moving the foot support in a vertical direction. The height of the seat 30 may then be adjusted in a conventional fashion. When the user adjusts the height of the seat 30 from a first position to a second position, the inner telescoping tube 210 moves vertically, the intermediate tube 180 moves vertically with the inner telescoping tube 210, which moves top cap 100 and thus foot support 70. Thus, the foot support 70 moves vertically when the seat 30 is vertically adjusted.

As the seat 30 is rotated, the inner telescoping tube 210 rotates with respect to the intermediate tube 180. The tilt mechanism 32 engages the guide pin 126 extending upwards from gear housing 120 to rotate the gear housing 120 with the seat 30. The gear housing 120 rotates with respect to the top cap 100, which remains fixed with base 60 and foot support 70. As the gear housing 120 rotates with respect to the top cap 100, the inner annular surface 168 moves against the outer annular surface of the vertically extending portion 104, and the bottom surface 128 of the gear housing 120 and bottom retainer 236 move against the top surface 112 of the horizontally extending portion 106. The foot support 70 does not rotate when the seat 30 is rotated. Because gear wheel 196 remains fixed with respect to the foot support 70, as the gear housing 120 rotates gear wheel 190 also rotates. The handle 134 rotates as this occurs to account for the rotational movement of the gears as the housing 120 is moved.

Figure 9:
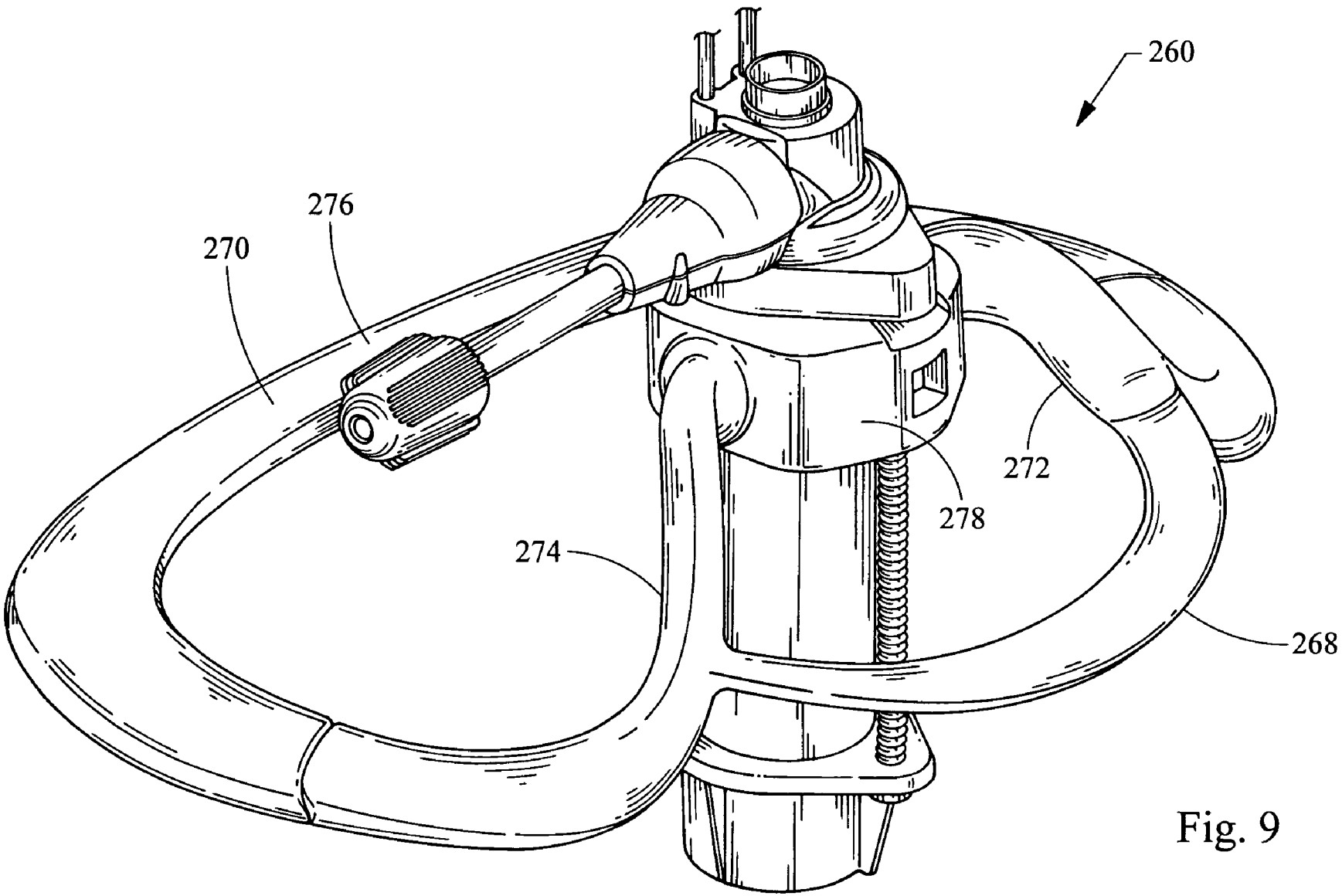
FIG. 9 is a perspective view of a second embodiment of a foot support assembly.

FIG. 9 shows a second embodiment of a foot support assembly 260. The foot support assembly 260 is outwardly similar in most respects to the first embodiment 20 shown in FIG. 2. The foot support 270 has a different design. Foot support 270 extends around only the front portion of the seat 30. The foot support 270 includes two arms 272, 274 connecting a foot resting surface 276 to a center portion 278. A rear portion 268 connects the two arms 272, 274.

Figure 10:
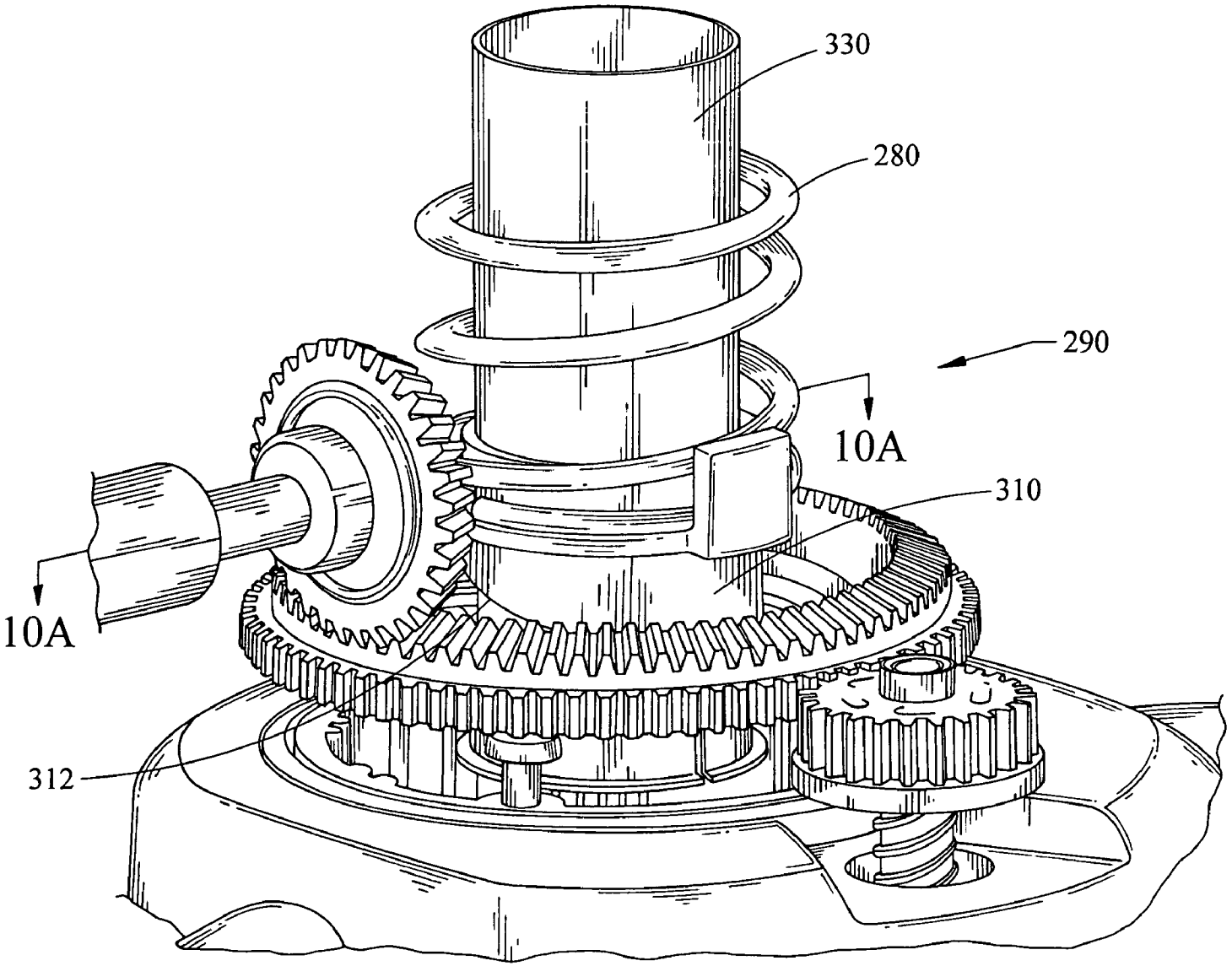
FIG. 10 is a perspective view of the gear components of a second embodiment of a foot support assembly.
Figure 10A:
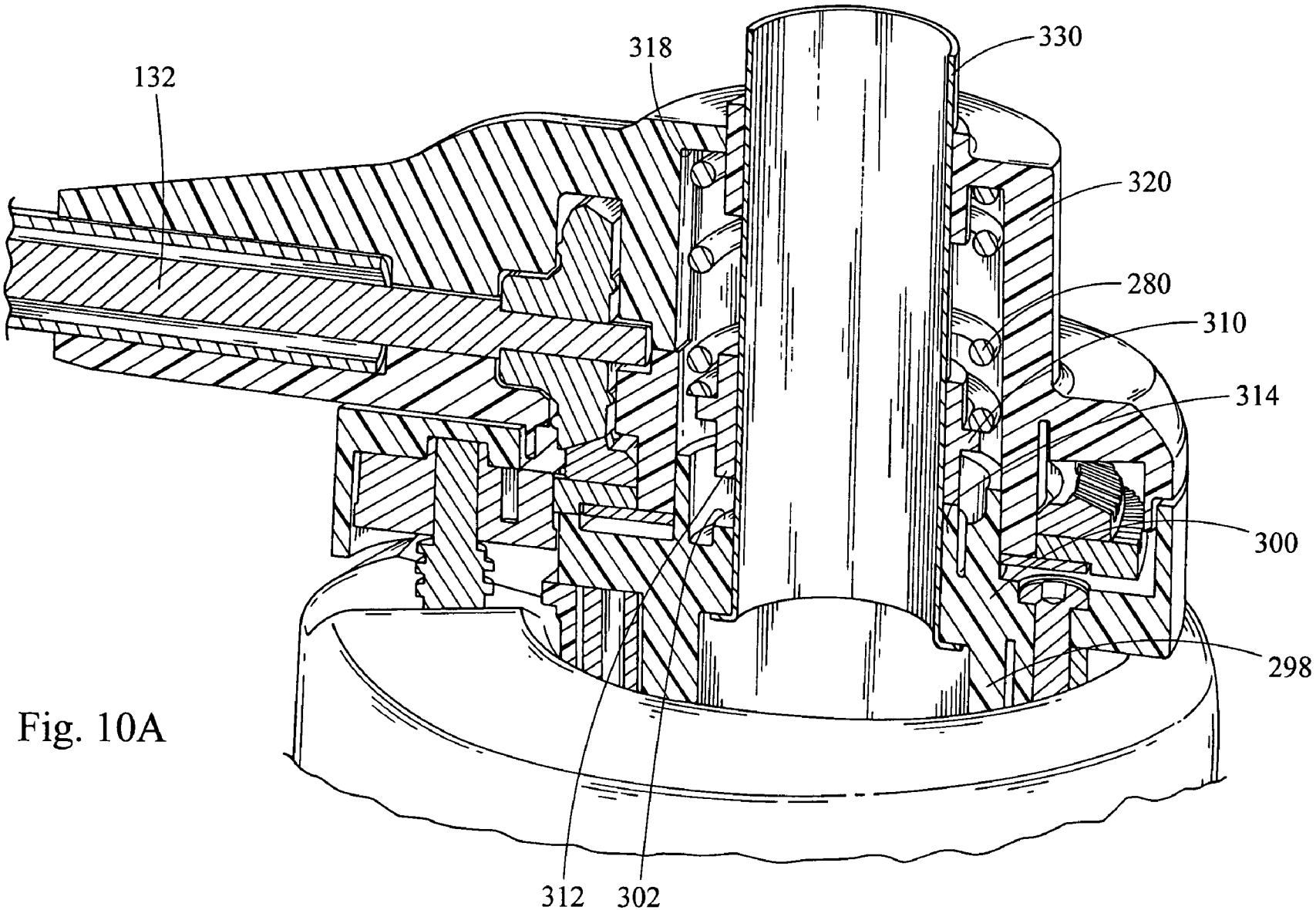
FIG. 10A is a sectional view along line 10A-10A of FIG. 10.
Figure 11:
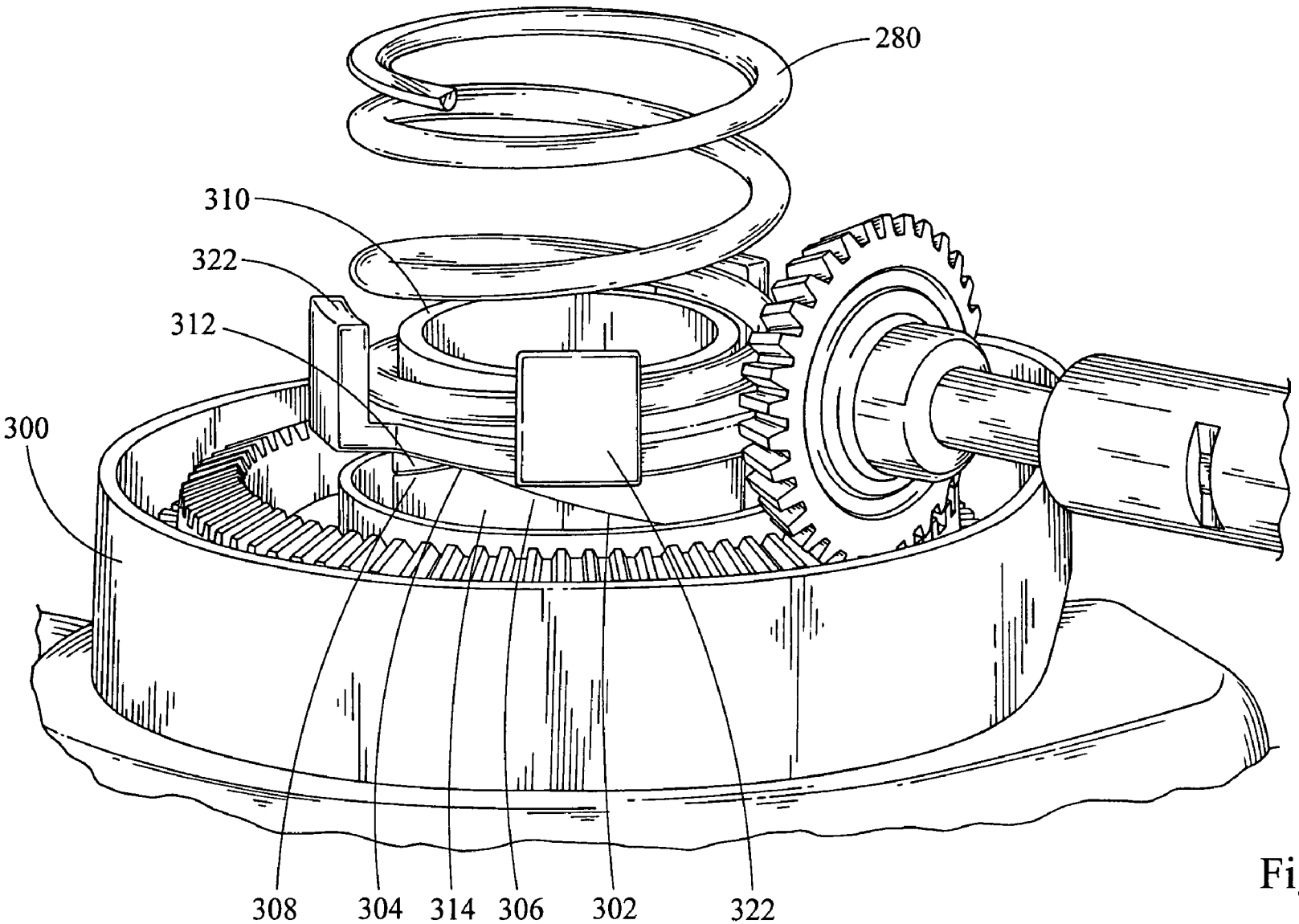
FIG. 11 is a perspective view of the gear components of a second embodiment of a foot support assembly.

FIGS. 10, 10A, and 11 show the gear components of the second embodiment of a foot support assembly 260. The components of the second embodiment of a foot support assembly 260 are similar to those of the first embodiment except where noted herein. A biasing member 280 is operably coupled to the seat 30 and to the foot support 270 to bias the seat 30 toward a forward position. The top portion of the biasing member 280 is vertically limited by a circular channel 318 in the top portion of the gear housing 320. As best seen in FIG. 11, the top cap 300 includes a center annular portion 314 with an upwardly-facing ramped surface 302. In one embodiment, the ramped surface 302 includes two upwardly angled surfaces 306, 308 connecting at a peak 304. Contacting the ramped surface 302 and disposed thereon is an engaging member 310 with a downwardly-facing ramped surface 312. The downwardly-facing ramped surface 312 is preferably complementary in shape to the upwardly-facing ramped surface 302. The engaging member 310 rotates with the gear housing 320 but can move vertically with respect thereto.

As a rotational force is exerted on the seat 30, the gear housing 320 rotates with the seat 30. Engaging member 310 rotates with respect to the top cap 300, and the ramped surfaces 302, 312 slide along each other, thus forcing the engaging member 310 upward in gear housing 320. This upward movement compresses the biasing member 280, which exerts a biasing force downward. Thus, when the force rotating the seat 30 is removed, the biasing member 280 forces the engaging member 310 back down, the ramped surfaces 302, 312 slide towards their original positions, and the seat 30 is forced back to a neutral position. In one embodiment, the biasing member 280 is a spring.

FIG. 10A is a sectional view along line 10A-10A of FIG. 10. The control mechanism 290 of the secondary embodiment is similar to the first embodiment in many respects. In the second embodiment, the top cap 300 includes as an integrated piece a bottom insert portion 298. Additionally, the top cap 300 includes a center annular portion 314 with a ramped top surface 302 adapted to engage the bottom surface 312 of the engaging member 310. The engaging member 310 and the biasing member 280 are disposed in the gear housing 320. The inner telescoping tube 210 (not shown) is vertically disposed through the top cap 300 and gear housing 320. In one embodiment, a bushing 330 surrounds the inner telescoping tube 210.

Figure 12:
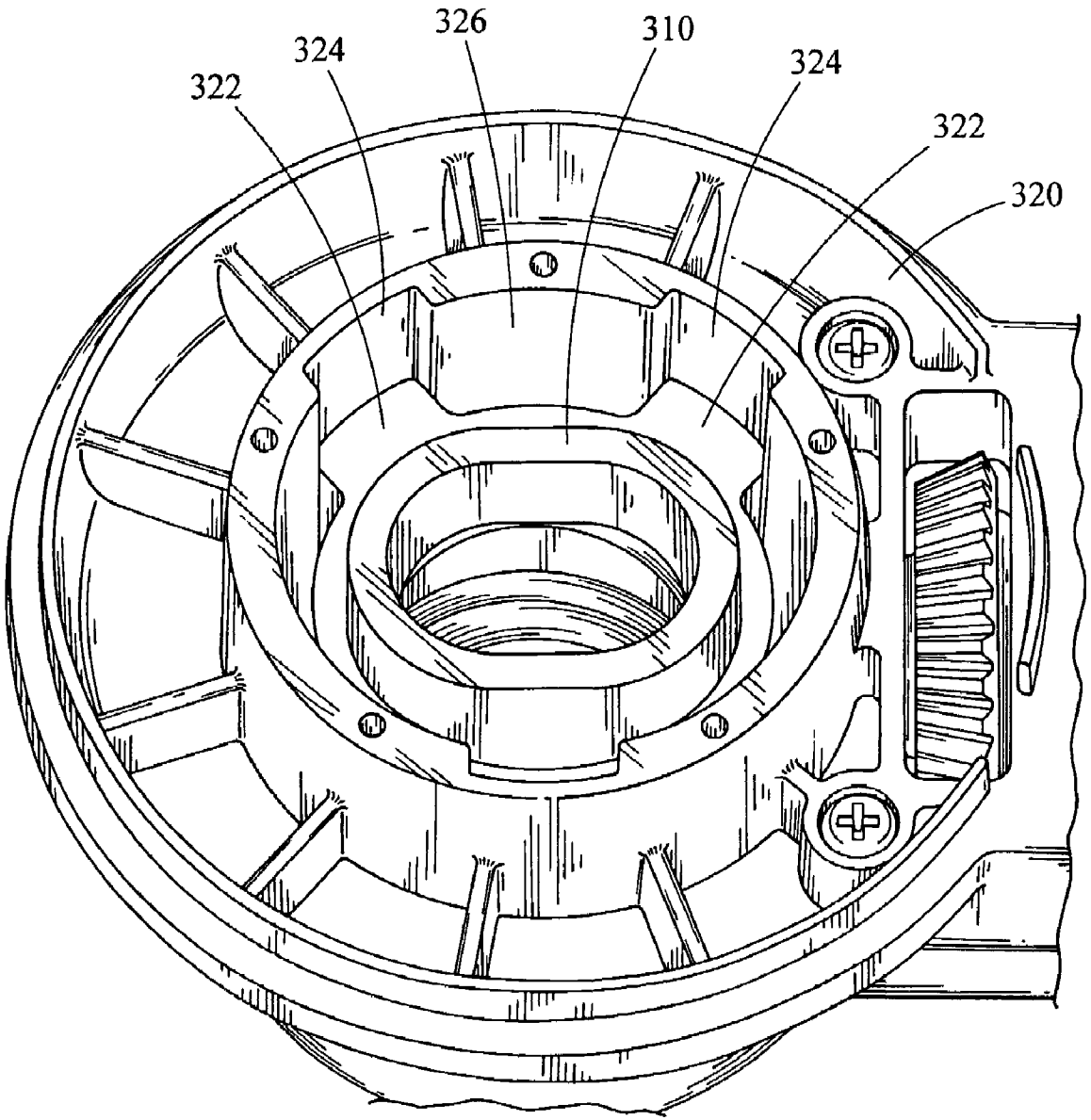
FIG. 12 is a bottom view of the gear housing of a second embodiment of a foot support assembly.

FIG. 12 is a bottom view of the gear housing 320 of the second embodiment of a foot support assembly. The engaging member 310 has outwardly extending tabs 322 which engage channels 324 in the inner annular portion 326 of the gear housing 320. This arrangement allows the engaging member 310 to rotate with the housing 320 and move axially relative thereto. In one embodiment, the engaging member 310 has three tabs 322, but other numbers of tabs 322 are possible. In another embodiment (not shown), the engaging member 310 has channels on the outer surfaces and the inner surface of the gear housing 320 has complementary tabs fitting within the channels.

Although the present invention has been described with reference to preferred embodiments, those skilled in the art will recognize that changes may be made and formed in detail without departing from the spirit and scope of the invention. It is therefore intended that the foregoing detailed description be regarded as illustrative rather than limiting, and that it be understood that it is the following claims, including all equivalents, that are intended to define the scope of this invention.

What is claimed is:

1. A chair comprising:

a base;

a seating structure rotatably coupled to the base about a vertical axis and independently vertically moveable between at least a first position and a second position, wherein the seating structure is rotatable about the vertical axis independent of any vertical movement of the seating structure between the first and second positions;

a foot support disposed a vertical distance from the seating structure and rotatably coupled to the seating structure and non-rotatably coupled to the base, wherein the foot support is vertically moveable relative to the base free of any rotation about the vertical axis relative to the base, wherein the base comprises a support column with an upper portion coupled to the seating structure and rotationally coupled to the foot support, wherein the foot support and the upper portion of the support column move vertically with the seating structure when the seating structure is moved between the first position and the second position; and a control mechanism operably coupled to the foot support for adjusting the vertical distance between the foot support and the seating structure without rotating the seating structure, the control mechanism comprising a control handle operably coupled to the seating structure such that the control handle rotates with the seating structure while the foot support remains non-rotatably stationary when the seating structure is rotated, and wherein the control handle moves vertically with the seating structure when the seating structure is vertically moved between the first position and the second position.

2. The chair of claim 1, wherein the seating structure is a seat.

3. A chair comprising:

a seating structure rotatably coupled to a base and vertically moveable between at least a first position and a second position;

a foot support disposed a vertical distance from the seating structure and rotatably coupled to the seating structure and non-rotatably coupled to the base;

a control mechanism operably coupled to the foot support for adjusting the vertical distance between the foot support and the seating structure, the control mechanism comprising a control handle operably coupled to the seating structure such that the control handle rotates with the seating structure when the seating structure is rotated and moves vertically with the seating structure when the seating structure is vertically moved between the first position and the second position; and wherein the base comprises a support column with an upper portion coupled to the seating structure and rotationally coupled to the foot support, wherein the foot support and the upper portion of the support column move vertically with the seating structure when the seating structure is moved between the first position and the second position, wherein the support column comprises a vertically extendable spring.

4. The chair of claim 1, further comprising a lead screw operably coupling the foot support to the control mechanism.

5. A chair comprising:

a base;

a seating structure rotatably coupled to the base and vertically moveable between at least a first position and a second position;

a foot support disposed a vertical distance from the seating structure and rotatably coupled to the seating structure and non-rotatably coupled to the base; and a control mechanism operably coupled to the foot support for adjusting the vertical distance between the foot support and the seating structure, the control mechanism comprising a control handle operably coupled to the seating structure such that the control handle rotates with the seating structure when the seating structure is rotated and moves vertically with the seating structure when the seating structure is vertically moved between the first position and the second position, the control mechanism further comprising a lead screw operably coupling the foot support to the control mechanism, and a control shaft comprising a first and second end, the first end comprising the control handle and the second end operably coupled to a first gear wheel; and a second gear wheel operably coupling the first gear wheel to the lead screw, such that rotation of the control shaft causes vertical movement of the foot support.

6. The chair of claim 1, further comprising a support tube vertically disposed over at least a portion of the support column.

7. The chair of claim 6, wherein the foot support comprises a center aperture, the center aperture disposed around the support tube, and the foot support is adapted to slide up and down the support tube.

8. The chair of claim 1, further comprising:

a housing disposed around at least a portion of the control mechanism; and a top cap non-rotatably coupled to the foot support, wherein the housing rotates with respect to the top cap when the seating structure is rotated.

9. The chair of claim 8 wherein the housing comprises a pin operably coupled to the seating structure to allow the housing to rotate with respect to the top cap when the seating structure is rotated.

10. The chair of claim 1, further comprising a biasing member, the biasing member operably coupled to the seating structure and to the base to bias the seating structure toward a forward position with respect to the base.

11. The chair of claim 8 wherein the top cap comprises a first surface, further comprising a second surface and a biasing member operably coupled to the second surface, the second surface adapted to slide along the first surface, the biasing member biasing the seating structure toward a forward position.

12. The chair of claim 11 wherein the first and second surfaces are ramped and the first surface faces upward and the second surface faces downward.

13. The chair of claim 12, further comprising an engaging member comprising the second surface, the engaging member coupled to the biasing member and vertically moveable with respect to the housing.

14. A chair comprising:

a seating structure rotatably coupled to a base and vertically moveable between at least a first position and a second position;

a foot support disposed a vertical distance from the seating structure and rotatably coupled to the seating structure and non-rotatably coupled to the base;

a control mechanism operably coupled to the foot support for adjusting the vertical distance between the foot support and the seating structure, the control mechanism comprising a control handle operably coupled to the seating structure such that the control handle rotates with the seating structure when the seating structure is rotated and moves vertically with the seating structure when the seating structure is vertically moved between the first position and the second position;

wherein the base comprises a support column with an urser portion coupled to the seating structure and rotationally coupled to the foot support, wherein the foot support and the urser portion of the support column move vertically with the seating structure when the seating structure is moved between the first position and the second position;

a support tube vertically disposed over at least a portion of the support column, the support tube comprising a top portion, a housing disposed around at least a portion of the control mechanism; and a top cap non-rotatably coupled to the foot support and disposed at the top portion of the support tube and affixed thereto, wherein the housing rotates with respect to the top cap when the seating structure is rotated.

15. The chair of claim 14, further comprising a top insert disposed at least in part between the support tube and a spring, the top insert affixed to the top cap.

16. The chair of claim 3 further comprising:

a support tube vertically disposed over at least a portion of the spring, the support tube comprising a bottom portion;

a bottom cap disposed at the bottom portion of the support tube and connected thereto; and a lead screw operably coupling the foot support to the control mechanism, wherein the lead screw comprises a bottom end rotatably connected to the bottom cap.

17. The chair of claim 16, further comprising a bottom insert disposed at least in part between the support tube and the spring and connected to the bottom cap.

18. A chair comprising:

a base;

a seat rotatably coupled to the base and vertically moveable between at least a first position and a second position, the seat comprising a top surface with a nadir and a side edge, the side edge defining a vertical plane and the nadir defining a horizontal plane;

a foot support disposed a vertical distance from the seat and rotatably coupled to the seat and non-rotatably coupled to the base;

a control mechanism operably coupled to the foot support for adjusting the vertical position of the foot support, the control mechanism comprising a control handle with a distal end, wherein the distal end of the control handle is disposed at a horizontal location within 3 inches of the vertical plane defined by the side edge of the seat and a vertical location within 18 inches of the horizontal plane defined by the nadir of the top surface of the seat, and wherein the control handle is operably coupled to the seat such that the control handle rotates with the seat while the foot support remains non-rotatably stationary when the seat is rotated and moves vertically with the seat when the seat is vertically moved between the first position and the second position; and a lead screw operably coupling the foot support to the control mechanism.

19. The chair of claim 18, wherein the distal end of the control handle is disposed at a horizontal location within 2 inches of the vertical plane defined by the side edge of the seat and a vertical location within 15 inches of the horizontal plane defined by the nadir of the top surface of the seat.

20. A chair comprising:

a base;

a seat rotatably coupled to the base and vertically moveable between at least a first position and a second position, the seat comprising a top surface with a nadir and a side edge, the side edge defining a vertical plane and the nadir defining a horizontal plane;

a foot support disposed a vertical distance from the seat and rotatably coupled to the seat and non-rotatably coupled to the base; and a control mechanism operably coupled to the foot support for adjusting the vertical position of the foot support, the control mechanism comprising a control handle with a distal end, wherein the distal end of the control handle is disposed at a horizontal location within 3 inches of the vertical plane defined by the side edge of the seat and a vertical location within 18 inches of the horizontal plane defined by the nadir of the top surface of the seat, a lead screw operably coupling the foot support to the control mechanism, a control shaft comprising a first and second end, the first end comprising the control handle and the second end operably coupled to a first gear wheel; and a second gear wheel operably coupling the first gear wheel to the lead screw, such that rotation of the control shaft causes vertical movement of the foot support.

21. The chair of claim 18, further comprising:

a housing disposed around at least a portion of the control mechanism; and a top cap non-rotatably coupled to the foot support, wherein the housing rotates with respect to the top cap when the seat is rotated.

22. The chair of claim 21, wherein the housing comprises a pin operably coupled to the seat to allow the housing to rotate with respect to the top cap when the seat is rotated.

23. A method of adjusting a foot support comprising:

providing a chair comprising:

a base comprising a support column;

a seat supported by the support column and vertically moveable between at least a first position and a second position;

the foot support, wherein the foot support is disposed a vertical distance from the seat and rotatably coupled to the seat and non-rotatably coupled to the base; and a control mechanism operably coupled to the foot support;

sitting on the seat;

rotating the seat and control mechanism about a vertical axis without moving the seat in a vertical direction;

adjusting the control mechanism while sitting on the seat to change the vertical distance between the seat and the foot support without vertically moving or rotating the seat and without rotating the foot support; and moving the seat between the first position and the second position, wherein the foot support moves vertically with the seat as the seat is moved between the first position and the second position.

24. The method of claim 23, wherein the control mechanism comprises a control handle, further comprising rotating the seat, such that the control handle rotates with the seat and the foot support does not rotate with the seat.

25. The method of claim 23, wherein the control mechanism comprises a control handle, wherein adjusting the control mechanism comprises rotating the control handle.

* * * * *

UNITED STATES PATENT AND TRADEMARK OFFICE

CERTIFICATE OF CORRECTION

PATENT NO. : 7,530,639 B2
APPLICATION NO. : 11/455013
DATED : May 12, 2009
INVENTOR(S) : John C. Groelsma et al.

It is certified that error appears in the above-identified patent and that said Letters Patent is hereby corrected as shown below:

In the Claims

In column 11, claim 14, line 32, after "support column with an" replace "urser" with --upper--.

In column 11, claim 14, line 35, before "portion of the support column" replace "urser" with --upper--.

Signed and Sealed this
Nineteenth Day of July, 2011

David J. Kappos

David J. Kappos
*Director of the United States Patent and Trademark Office*